United States Patent [19]

Fresnel

[11] 4,066,866

[45] Jan. 3, 1978

[54] APPARATUS FOR SHRINKING SLEEVES AROUND CONTAINERS

[75] Inventor: Jacques Fresnel, Paris, France

[73] Assignee: SLEEVER Societe de droit francais (S.a.r.l.), Morangis, France

[21] Appl. No.: 731,090

[22] Filed: Oct. 8, 1976

[30] Foreign Application Priority Data

Oct. 9, 1975 France ..... 75.30896

[51] Int. Cl.[2] ..... F27B 9/06; F27D 11/02

[52] U.S. Cl. ..... 219/388; 34/216; 34/236; 53/184 S; 156/86; 156/423; 156/497; 432/144

[58] Field of Search ..... 156/423, 497, 499, 86, 156/85, 165, 212; 432/144; 34/216, 217, 236; 53/184 S; 219/388, 400

[56] References Cited

U.S. PATENT DOCUMENTS

| | | | |
|---|---|---|---|
| 3,267,585 | 8/1966 | Futer | 34/236 |
| 3,711,961 | 1/1973 | Spiegel et al. | 34/236 X |
| 3,760,154 | 9/1973 | Konger | 53/184 S X |
| 3,808,702 | 5/1974 | Laessig | 53/184 S X |
| 3,897,671 | 8/1975 | Higgins | 53/184 S X |
| 3,959,065 | 5/1976 | Ashcroft | 156/423 |

*Primary Examiner*—William A. Powell
*Assistant Examiner*—Thomas Bokan
*Attorney, Agent, or Firm*—Browdy and Neimark

[57] ABSTRACT

An apparatus for shrinking heat-shrinkable sleeves around containers or the like includes at least two diffuser housings mounted respectively adjacent side edges of a conveyor on which containers or other objects having a sleeve thereon are to pass. A cap which defines a tunnel is positioned between the two diffuser housings over the conveyor. Each diffuser housing is provided with a longitudinally extending slot presenting directional discontinuity at its two end portions. The two end portions of each slot may be horizontal, while the control portion of each slot is sloped in a vertical direction and extends from one end portion of the slot to the other. Provision is made to feed hot air through the slots into a tunnel so as to contact the films on the containers or objects moved by the conveyor.

13 Claims, 7 Drawing Figures

APPARATUS FOR SHRINKING SLEEVES AROUND CONTAINERS

BACKGROUND OF THE INVENTION

This invention relates to an apparatus having means for producing and circulating hot air, intended particularly for shrinking a plastic film or the like around a support, such as a container. More particularly, the present invention concerns a novel apparatus for shrinking thermoplastic sheaths or sleeves around containers of different shapes and types.

It has been known for a long time to use films of thermoplastic material, such as polyvinyl chloride or the like as a means of packaging and displaying various articles, these films being capable of shrinking when exposed to the action of heat at a temperature close to the softening point of the material. Tunnel ovens of an appropriate length are used to cause shrinking, wherein the hot air, emerging from the ceiling, base or the side walls of the oven, is uniformly distributed over the entire length of the tunnel within which an endless conveyor carrying the articles to be packaged runs before moving to the outside of the oven. The purpose of this circulation of hot air is to condition the total surface of the packaging film in question, then to bring the film to the softening stage in order to release the stresses created when the film is stretched and to accomplish this as uniformly as possible.

The use more recently of sheaths or sleeves obtained by longitudinal joining of two contiguous edges of a heat-shrinkable film for the purpose of enclosing all or part of containers of various shapes, such as bottles, aerosol cans, cans of food and the like, thereby creating an ornamental strip, has posed a number of problems in the shrinking stage. In total or partial sheathing of the containers, the problem is not one of producing uniform distribution of the heat intended for shrinking, but one of creating zones wherein the air temperature is variable, for example increasing progressively, in order to cause selective shrinking of the film over the various parts, of more or less complex configuration, of the container to be sheathed. Hence, classical shrinking ovens are generally unsuited for this type of operation.

In one attempt to overcome this difficulty, a tunnel oven has been proposed, intended especially for shrinking of plastic rings or bands around the neck of containers, wherein movable side walls are provided, the side walls being movable lengthwise and/or vertically, so that the hot air, emerging from a slit disposed along these walls, can briefly touch the base of the ring or band and then, moving upward, the upper part of the ring or band when the container to be sheathed circulates continuously on a horizontal conveyor which traverses the oven. An oven of this type requires numerous elements intended to ensure the mobility of the walls, contributing to a relatively high cost and resulting in an apparatus of considerable complexity. Moreover, the control of the orientation of the walls, wherein heating elements are installed, is a delicate operation and one which must be carried out frequently for each type and/or size of container and sleeve.

To overcome the aforementioned disadvantages to a degree, a novel tunnel oven has been proposed wherein the hot air follows a selective path and is continuously recycled, the oven being provided with deflectors of a movable and adjustable type allowing selective and progressive direction of the hot air with respect to the various zones of the sleeve to be heat shrunk around a container. A tunnel oven of this kind, with a simple design and low cost, is completely satisfactory as far as effectiveness where directed to the application of sleeves to containers of complex shape is concerned. Nevertheless, use of a tunnel oven of this kind is generally limited to cases of partial or total coverage of containers whose height is not great, so that the circulation on the conveyor belt can be effected normally without the containers striking the upper part or roof of the oven. Of course, an oven with large dimensions can be provided, this oven being designed for objects of considerable height, but the effectiveness and efficiency of the selective direction of the hot air is then considerably and undesirably reduced.

SUMMARY OF THE INVENTION

The present invention brings a new solution to the problem of the application of sheaths or sleeves to containers and objects of large size and complex configuration in order to obtain progressively, from one end of the container or object to the other, a virtually perfect adhesion of the heat-shrinkable film.

It is the principal object of the present invention to provide an apparatus for shrinking films around large containers in which the surface of the containers may be either partially or totally sheathed with virtually no resulting surface defects. By employing a movable and adjustable means for blowing in the hot air, the apparatus of the present invention permits considerable flexibility in adapting the shrinking operation to continuous assembly lines, of manufacture, opening and placing the plastic sheaths, sleeves, caps, rings or the like around the containers to be protected and/or decorated.

The apparatus according to the invention is characterized by the fact that it includes essentially at least one diffuser housing which is adjustable in all directions, the housing being mounted on a movable stand and adjacent a side edge of the location of a conveyor belt which is to carry containers covered at least in part with a heat-shrinkable sleeve to be shrunk and the housing being provided at its base with a lengthwise hot-air inlet slot with directional discontinuity at its two ends.

In practice, the directional discontinuity of the forced air slot is advantageously achieved by using as the housing an elongated element of an essentially parallelepipedal shape whose walls delimit a hollow enclosed space, except for the slot, and which is constituted by an integral central part, in whose ends articulated retractable sections are jointed in such manner that three slots are in fact obtained of which two at least can be located in planes at different levels. As is to be explained in detail hereinbelow, the operative possibility of these slots being oriented and their adjustment, as a function of the various parts of the container to be enclosed in a sleeve or the like formed by a heat-shrinkage film constitutes a most desirable factor for achieving the results which are the aim of the invention.

According to a particularly advantageous embodiment, one of the articulated retractable sections of the diffuser housing has a length which is considerably greater than that of the other section; the longer retractable section, and hence the slot as well, is disposed in the upstream section of the housing. In other words, the longer section is the one where the thermoplastic sleeve, sheath or the like is first exposed to the flow of hot air. Thus, a portion of the slot serves to preheat the cold film before the shrinking operation proper. Moreover, in a preferred embodiment, the hot air diffusion slots in different parts of the diffuser housing, are extended and defined by lips which are separated by at least 1 cm. from the base of said housing. Finally, it has been found that hot air circulation can be improved further, without turbulence, around the container covered with its associated sleeve to be shrunk by disposing between each of two diffuser housings located in the vicinity of both side edges of the conveyor belt, a perforated cap within which the containers with their heat-shrinkable sleeves move along or circulate while being exposed to the flow of hot air for shrinking of the film.

The hollow space inside each diffuser housing is partitioned into several zones by means of plates or baffles intended to break up the flow of hot air from the supply, creating a jet of gaseous fluid whose laminer layers are channeled and directed to the levels of the diffusion slot or slots. Each diffuser housing is supplied through one or more openings located in the central part and the source of hot air can come from one or more extractor fans, each provided with a heating sleeve, and which can force air to the inside of the housing, the temperature of said air being advantageously between from substantially 500° to substantially 650° C. However, in a preferred embodiment, the extractor fans supplied with heating sheaths can be replaced by a single fan, in this case providing a series of electrical heating resistors in the baffle zones in the hollow interior of the housing. In one version, these electrical resistors can be replaced by coils wherein a high-temperature, heating fluid circulates.

All of the diffusing housings and their associated elements are mounted so as to be universally adjustable on a movable base. Thus, the apparatus according to the invention is easily transported and can be quickly disassembled and reassembled very readily, with little expenditure of time. Owing to its unlimited adjustment capability, the apparatus of the present invention is readily adapted to all kinds of assembly lines and continuously applies plastic sleeves, sheaths, caps or rings around containers or groups of objects to be regrouped and/or decorated. In addition, as is to be explained in detail hereinbelow, the apparatus is advantageously provided with its own conveyor belt for the containers and is therefore independent, unlike the tunnel ovens used for shrinking heat-shrinkable films about containers and the like which have been described and used hitherto.

According to an improvement and another characteristic of a preferred embodiment of the invention, the conveyor mounted on the apparatus described hereinabove is advantageously of the rotating plate type. Following the shrinking of the plastic heat-shrinkable sleeves around large-diameter containers, the jet of hot air emerging from the adjustable slot in the housing is generally effective only on those portions of the container which are in direct contact with and approach this fluid jet; hence, one or more "free" zones may remain on the container, where the shrinking of the plastic film is imperfect, thus causing surface irregularities in the sleeve, sheath, cap or ring on the container. Using a rotating-plate conveyor according to the preferred embodiment allows this shortcoming to be eliminated by virtue of the fact that it presents the total circumference of each container to the action of the hot-air jets.

In one embodiment, this system of rotating plates is created by making appropriate modifications to a monoplanar chain of plates, of known type, in which a support plate for the container is mounted between two links, the axis of said plate, driven by friction, comprising a bevelled disk which engages a multifaceted rail. By using a system of this kind, the oscillating movement of known plate conveyors is transformed into an essentially circular movement wherein the plates, supporting the containers to be enclosed in sleeves or sheaths, execute one or more turns during which each container is subjected to the action of the air flow.

According to another possible embodiment, the rail mentioned hereinabove can be replaced by a belt given a variable linear velocity, for example, by means of a gear train, allowing the speed of the plate to be adjusted to the needs of the user and according to the requirements for the products to be obtained. Finally, in the two embodiments mentioned hereinabove, it is advantageous to provide zones wherein the containers pause, so as to allow concentrating heat on this particular point on the container to be sheathed. In order to achieve this result, it suffices to make the belt support in the form of several sections, one of the latter being displaced downward relative to the adjacent sections.

BRIEF DESCRIPTION OF THE DRAWING

The invention will be better understood from the detailed description of the non-limitative embodiments with reference to the attached drawings, in which.

DETAILED DESCRIPTION OF THE PREFERRED EMBODIMENTS

Figure 1:
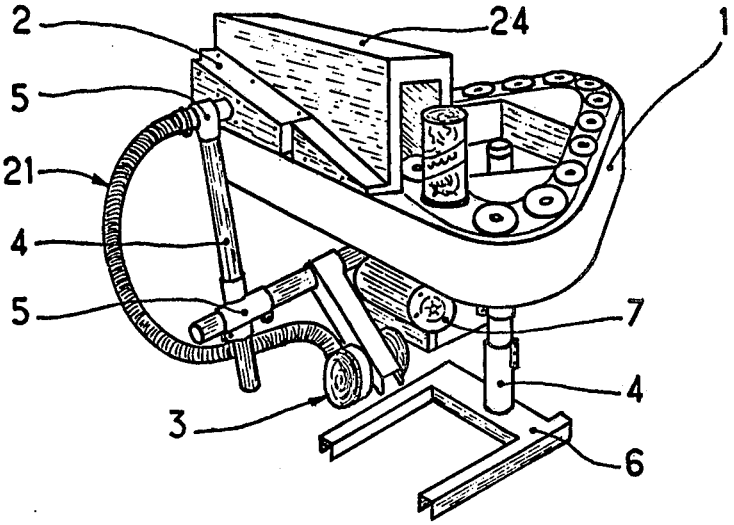
FIG. 1 is a perspective, particularly diagrammatic, view of an apparatus according to the invention.

The apparatus according to the invention, one embodiment of which is shown in FIG. 1, includes essentially two diffuser housings 2, located adjacent both side edges of a conveyor belt 1, the housings 2 being supplied with air by a fan 3 of conventional design, the air being superheated inside the diffuser housings 2 as is to be explained in detail hereinbelow. All of the elements are supported by adjustable support tubes 4 connected together by clamps 5, one of the tubes 4 being provided with a base 6 which serves to support the complete apparatus. Thus, each of the elements is movable and universally adjustable, and the apparatus is easy to assemble, to disassemble and to transport. The conveyor belt 1 is driven by a motor 7 or a variable-speed gear train.

Figure 2:
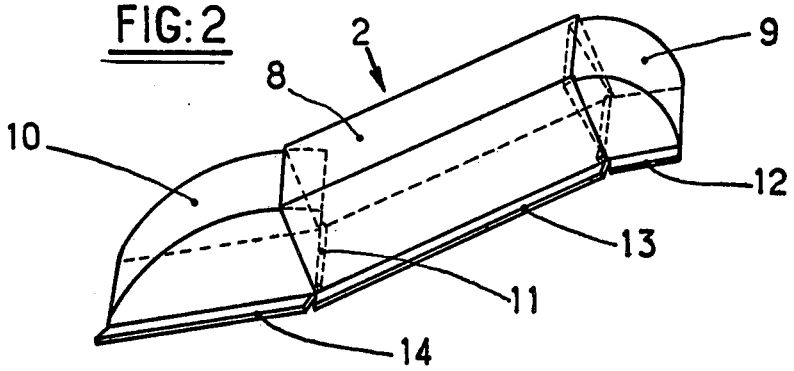
FIG. 2 is a perspective view of a diffuser housing, provided with lips having directional discontinuity which can be used in an apparatus according to the present invention.
Figure 3:
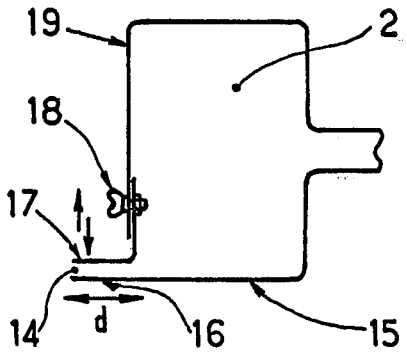
FIG. 3 illustrates an arrangement for adjusting the distance between the lips in a section of the housing of FIG. 2.

One of the diffuser housings 2, as is clearly shown in FIG. 2, has the general shape of an elongated rectangular parallelepiped, including a central section 8 wherein are articulated at each end, two retractable sections 9 and 10, the sections 9 and 10 being articulated by respective hinges 11 or equivalent means to fit into the central section 8. At the base of each of its section 8, 9 and 10, the diffuser housing 2 is provided with respective slot 13, 12 and 14 defined by lips extending from respective side walls of the sections 8, 9 and 10 separated by at least 1 centimeter from the base of the housing 2, and which, by virtue of the hinges 11, exhibit directional discontinuity. In practice, as is evident from FIG. 3, a bottom 15 of the housing 2 is extended by a flange 16, and a metal plate 17 is disposed above this extension, the plate 17 being of the same length and having its distance relative to the bottom 15 and to the flange 16 adjustable by means of a nut-and-bolt arrangement 18 or the like, operating in an oblong hole provided in a wall 19 of the housing 2. In general, the distance "*d*" (FIG. 3), that is the length of the passageway defined by the horizontal portion of metal plate 17 and a portion of the bottom 15, is about 2 to 3 or 4 centimeters and the adjustable thickness of each of the slots 12, 13 and 14 formed by the lips, varies according to the type of container to be sheathed, the thickness being between 1 and 10 mm or more.

Systematic studies of continuous operation of the apparatus have shown that it was particularly advantageous to provide one of the retractable sections 10 of the diffuser housing 2 with a significantly greater length than the other retractable section 9; the longest slot 14 is disposed in the upstream part of the housing 2, in other words, the one where the heat-shrinkable sleeve or sheath is first exposed to the flow of hot air. Thus, one part of slot 14 allows the cold thermoplastic sleeve to be preheated prior to the shrinking operation proper.

Figure 4:
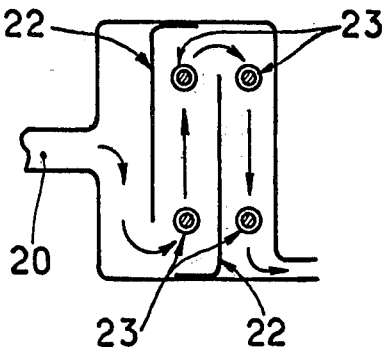
FIG. 4 is a cross-sectional view showing the inside of a diffuser housing which can be used in an apparatus according to the present invention.

The inside of one of the diffuser housings 2 is shown in FIG. 4. It includes a hollow enclosed space, provided with an opening 20, connected to the fan 3 by a tube or hose 21, as shown in FIG. 1, and walls 22 which define baffles between which are mounted armored, electrical heating resistors 23. According to one possible embodiment, these resistors can be replaced by heating coils within which a heating fluid heated to from about 300° to about 400° C circulates. Oil or another heat-conducting fluid could be used. Thus, the cold air fed by the extractor fan 3 into the opening 20 of the diffuser housing 2 circulates in the direction indicated in FIG. 4 by the arrow-headed lines and is heated by the resistors 23 or by the fluid coils before emerging in laminar form between the lips which form the slots 12, 13 and 14 of housing 2 (FIG. 2).

Figure 7:
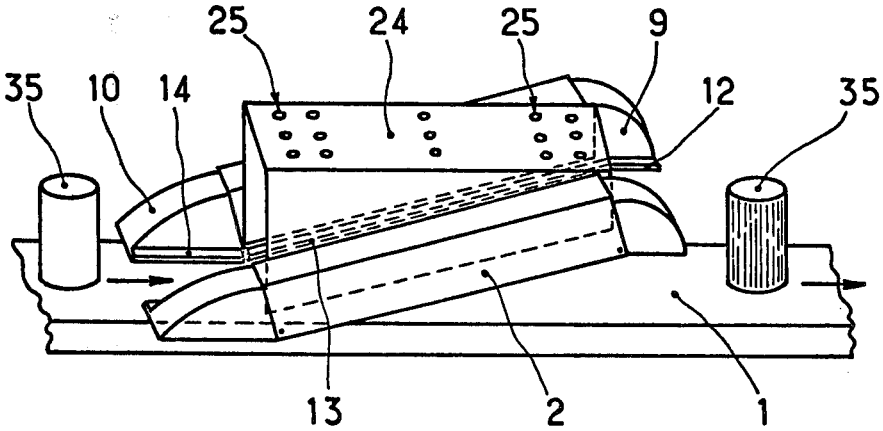
FIG. 7 is a perspective view of two diffuser housings, separating by the perforated cap or tunnel, between which the containers covered with heat-shrinkable plastic sleeves to be shrunk pass continuously on the conveyor belt.

According to a particularly advantageous embodiment of the invention, clearly shown by FIGS. 1 and 7, there is disposed between each of the two diffuser housings 2 disposed respectively adjacent both side edges of the conveyor belt 1, a tunnel-forming cap 24 provided with perforations 25 in its top and constituting in a sense a circulating tunnel for the hot air emerging from the slots 12, 13 and 14. This cap 24 has a parallelepipedal shape here and a length which is essentially equal to that of the diffuser housings 2; however, these parameters are not critical factors and may be adjusted to each particular case. Because of the cap 24, the draft of cool air which is generally created between the diffuser housings 2 by the jets of hot air emerging from slots 12, 13 and 14 can be eliminated and the hot air circulated in a natural manner without producing turbulence.

Figure 5:
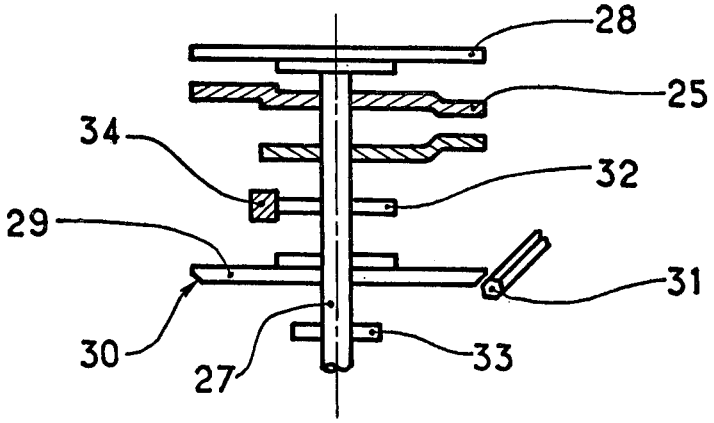
FIGS. 5 and 6 are respective schematic drawings of one section of a conveyor belt provided with rotating plates in accordance with a preferred embodiment of the present invention.
Figure 6:
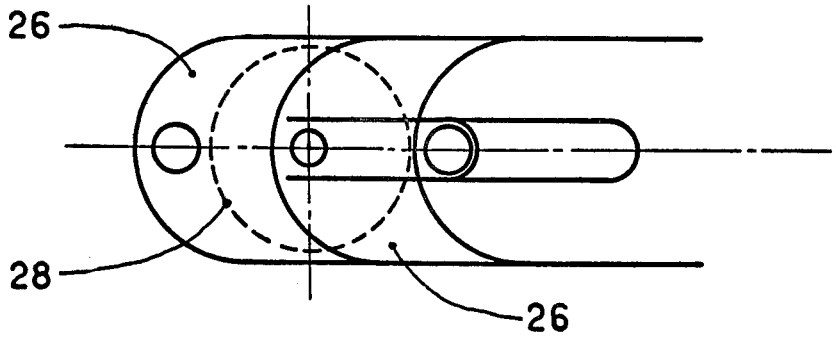

FIGS. 5 and 6 are a schematic representation of a section, of a conveyor arrangement design of a rotating plate which is suitable for adaptation to the conveyor belt 1. In this exemplary design, the arrangement includes a known monoplanar plate chain 26, for example in the form of crescents; at a junction axis 27 between each plate, a support plate 28 with a diameter matched to the bottom of each container to be enclosed in a sleeve or the like is installed. This plate 28 is integral with a drive disk 29 provided with a bevel 30 intended to engage a multifaceted rail 31 (for example, with a hexagonal section). One or more bearings 32 and 33 are provided to react to the thrust from the rail 31, the bearing 32 also serving to rest on a second rail 34 to complete the circular movement of the plate 28. In this manner, during the shrinking of the heat-shrinkable sleeve or sheath, each container can effect one or more turns on its axis and be subjected at all points to the continuous action of a jet of hot air. According to a variation of the embodiment (not shown in the drawings) the rails 31, 34 can be replaced by a belt with a variable linear velocity (driven, for example, by the gear train associated with the motor 7, FIG. 1) which allows the speed of the plate 28 to be adjusted to the needs of the user and according to the requirements of the products to be produced. Finally, in the two embodiments mentioned hereinabove, it is advantageous to provide areas wherein the containers can pause, allowing heat to be concentrated on a given point on the container to be sheathed. To achieve this result, it will suffice for example to make the support of the belt in several sections, one of said sections being displaced downward relative to the adjacent sections.

FIG. 7 illustrates in diagrammatic fashion using the diffuser housings 2 during the shrinking of the heat-shrinkable sleeve, around containers 35, for example, cylindrical cans as shown here, traveling along the conveyor belt 1 in the direction shown by the arrow-headed line, from left to right. Each of the housings 2 is preset such that the difference in level between the two articulated end sections 9 and 10 is essentially the same as or slightly greater than the height of the containers 35. Moreover, the slots 12 and 14 of the sections 9 and 10 respectively of each of the housings 2 are located in an approximately horizontal manner, while the slot 13 of the central section 8 of each of the housings 2, is inclined, as shown. When a container 35, fitted with its heat-shrinkable sheath, sheet, cap, ring or the like reaches the level of the slot 14, the latter delivers hot air which conditions the heat-shrinkable plastic film, after which the jet of hot air first of all attaches the sleeve to the bottom of this container, causing it to fit perfectly to the contours and edges of this container, the latter rotating on its axis and being made to pause, if necessary or desired. Finally, when this container 35 advances on the conveyor belt 1, the inclined slot 13 dispenses its flow of hot air over the body of this container and, when this container finally reaches the level of the slot 12, the upper end of the sleeve shrinks around the upper edge of this container, ensuring a perfect fit. Thus, because of the circulation of the hot air without turbulence beneath the tunnel cap 24 and the correct orientation, by means of the slots 12, 13 and 14, of the flow of hot air which allows the sealing of both of the ends and the body of the container with the sleeve, it is possible to match perfectly and progressively any type of sleeve, sheath, cap or ring to the shape of all or part of containers of various shapes and all heights.

Note that by virtue of the novel apparatus according to the invention all traditional hot air supply and control systems, which are generally not very reliable, thermal inertia of the ovens, drafts and the like are eliminated. Here, the hot air is provided automatically and continuously thanks on the one hand to the control of the multiple slots and on the other hand to the distance of the hot-air jet and the object being processed.

The new oven according to the invention, as described hereinabove or according to the variations by implementation of equivalent means, can be used for all operations involving shrinking of sheaths, caps, rins, sleeves or the like made of plastic, heat-shrinkable film around various containers or objects. It is particularly convenient for packaging totally or in part such containers as bottles, aerosol cans, or other containers, cans, tubes or different materials and with complex shapes, with plastic sleeves previously imprinted with any desired designs or decorations.

It will be obvious to those skilled in the art that various changes may be made without departing from the scope of the invention and the invention is not to be considered limited to what is shown in the drawings and described in the specification.

What is claimed is:

1. An apparatus for shrinking heat-shrinkable sleeves around containers or the like comprising a conveyor on which containers having heat-shrinkage sleeves thereon are to be moved; at least two diffuser housings, respective ones of said diffuser housings being positioned adjacent respective side edges of said conveyor and defining therebetween a heating station; at least one lengthwise slot for distributing hot air into said heating station extending along each said diffuser housing, said slot having a central portion having an inclination with respect to vertical and presenting vertical directional discontinuity along its two opposite end portions, said end portions having respective inclinations with respect to vertical different from the inclination of said central portion; and means for feeding hot air to said diffuser housings.

2. An apparatus according to claim 1, wherein each said diffuser housing comprises a central elongated section and two end sections, each of said end sections being articulated to said central section and having said end portions of said slots formed therein to provide for the directional discontinuity.

3. An apparatus according to claim 2, wherein that one of said two articulated sections in which the heat-shrinkage sleeves are to be first subjected to the influence of hot air flow has a length substantially greater than that of the other one of said articulated section.

4. An apparatus according to claim 2, wherein hollow space in each said housing is partitioned into several zones by baffles attached to walls of respective housings to define a zig-zag pattern through said zones for air, and heating means within said hollow spaces for heating air fed into said housings before it exits via said slots.

5. An apparatus according to claim 4, wherein said heating means comprise electrical heating resistors.

6. An apparatus according to claim 4, wherein said heating means comprise hollow heating means comprise hollow heating coils through which heating fluid is to flow.

7. An apparatus according to claim 2, wherein said slot in each housing is divided into three distinct hot-air diffusion slots in respective ones of said sections of each housing, these distinct slots being extended by respective lips spaced at least one centimeter from respective bases of each of said housings.

8. An apparatus according to claim 1, including a cap means mounted between said diffuser housings to define a tunnel, within which containers are to move while hot air is diffused over the films to shrink them.

9. An apparatus according to claim 8, wherein said cap means is provided with perforations to allow air to pass out of said tunnel.

10. An apparatus according to claim 1, wherein said conveyor is of a rotating plate type, constituted by a monoplanar chain with plates of known type, in which chain a support plate for supporting a container has been provided between each two chain links, an axis of said support plate comprising a beveled disk meshing with a multifaceted rail.

11. An apparatus according to claim 1, wherein said conveyor is of the rotating plate type and is provided with plates, said plates being driven by friction against a support, a drive being provided by a belt with a variable linear velocity, and including a support for said belt made in the form of a plurality of sections, at least one of which is displaced downward relative to the others, to produce at least one pause during rotation of a container on its corresponding plate.

12. An apparatus according to claim 1, wherein said end portions of said slot have respective inclinations with respect to vertical which are less than the inclination of said central portion.

13. An apparatus according to claim 1, wherein said end portions of said slot are substantially horizontal.

* * * * *